US008535093B1

(12) United States Patent
Mason

(10) Patent No.: US 8,535,093 B1
(45) Date of Patent: Sep. 17, 2013

(54) SOCKET HAVING SLEEVE ASSEMBLIES

(75) Inventor: Jeffery W. Mason, North Attleboro, MA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 13/414,345

(22) Filed: Mar. 7, 2012

(51) Int. Cl.
*H01R 13/648* (2006.01)

(52) U.S. Cl.
USPC ..... 439/607.05; 439/66; 439/91

(58) Field of Classification Search
USPC ..... 439/607.05, 66, 74, 91
See application file for complete search history.

(56) References Cited

U.S. PATENT DOCUMENTS

| | | | | |
|---|---|---|---|---|
| RE34,084 | E * | 9/1992 | Noschese | 439/66 |
| 5,380,210 | A * | 1/1995 | Grabbe et al. | 439/66 |
| 5,562,462 | A * | 10/1996 | Matsuba et al. | 439/70 |
| 6,027,345 | A * | 2/2000 | McHugh et al. | 439/66 |
| 6,183,266 | B1 * | 2/2001 | Turner | 439/66 |
| 6,672,881 | B2 * | 1/2004 | Evans | 439/71 |
| 6,932,618 | B1 * | 8/2005 | Nelson | 439/66 |
| 6,945,788 | B2 | 9/2005 | Trout et al. | |
| 7,621,756 | B2 * | 11/2009 | Dittmann | 439/66 |
| 2006/0046527 | A1 * | 3/2006 | Stone et al. | 439/66 |
| 2011/0014814 | A1 * | 1/2011 | Chang et al. | 439/607.05 |

* cited by examiner

*Primary Examiner* — James Harvey

(57) ABSTRACT

A socket includes a socket body having a first surface and a second surface with a plurality of openings extending between the first and second surfaces. Sleeve assemblies are received in corresponding openings of the socket body. Each sleeve assembly includes a socket contact configured to interconnect a first electronic component and a second electronic component and each sleeve assembly includes a conductive sleeve extending along a majority of a length of the socket contact between the first and second electronic components. The conductive sleeve provides electrical shielding for the socket contact such that each socket contact is individually shielded from other socket contacts.

19 Claims, 4 Drawing Sheets

SOCKET HAVING SLEEVE ASSEMBLIES

BACKGROUND OF THE INVENTION

The subject matter herein relates generally to a socket for interconnecting two electronic components.

Sockets are used to interconnect two electronic components, such as an integrated circuit (IC) component and a printed circuit board (PCB). Typically, the sockets include an array of contacts held by an insulative socket body. Some known sockets have cantilever beam designs for the contacts. Known sockets provide little or no electrical shielding between contacts. The electrical performance of the socket is affected by the lack of shielding of the contacts.

A need remains for a socket having improved electrical performance.

BRIEF DESCRIPTION OF THE INVENTION

In one embodiment, a socket is provided including a socket body having a first surface and a second surface with a plurality of openings extending between the first and second surfaces. Sleeve assemblies are received in corresponding openings of the socket body. Each sleeve assembly includes a socket contact configured to interconnect a first electronic component and a second electronic component and each sleeve assembly includes a conductive sleeve extending along a majority of a length of the socket contact between the first and second electronic components. The conductive sleeve provides electrical shielding for the socket contact such that each socket contact is individually shielded from other socket contacts.

Optionally, the conductive sleeve may provide shielding for an entire length of the socket contact between the first and second surfaces. The conductive sleeve may include a top end and a bottom end with the top end being flush with or extending exterior of the socket body beyond the first surface and with the bottom end being flush with or extending exterior of the socket body beyond the second surface. The openings may have a height measured between the first and second surfaces and the conductive sleeve may have a height measured between opposite top and bottom ends of the conductive sleeve where the height of the conductive sleeve is taller than the height of the opening. Optionally, the first surface may have a conductive layer and the conductive sleeves may be mechanically and electrically connected to the conductive layer such that each of the conductive sleeves is bussed together.

In another embodiment, a socket is provided having a socket body having a first surface and a second surface with a plurality of openings extending between the first and second surfaces. Sleeve assemblies are received in corresponding openings of the socket body. The sleeve assemblies each include a socket contact having a contact body, a tail extending from the contact body for electrical connection with an electronic component at the second surface of the socket body, and a spring beam extending from the contact body opposite the tail. The spring beam is angled with respect to the contact body and extends along, and is spaced apart from, the first surface of the socket body. The spring beam is deflectable toward the first surface of the socket body when mated with an electronic component at the first surface of the socket body. The sleeve assemblies each include an insulator surrounding the contact body. The insulator extends axially along the contact body at least partially between the tail and the spring beam. The sleeve assemblies each include a conductive sleeve surrounding the insulator. The conductive sleeve has an opening therethrough that receives the insulator and socket contact. The conductive sleeve, insulator and contact body are received in a corresponding opening of the socket body and the conductive sleeve provides shielding along the contact body between the first surface and the second surface.

In a further embodiment, a sleeve assembly for a socket is provided including a socket contact, an insulator and a conductive sleeve shielding the socket contact. The socket contact has a contact body, a solder ball tail extending from the contact body for electrical connection with a solder ball, and a spring beam extending from the contact body opposite the solder ball tail. The spring beam is angled with respect to the contact body. The spring beam is deflectable and is configured to be mated with and be biased against a first electronic component at a separable interface of the spring beam. The insulator surrounds the contact body. The insulator extends axially along the contact body at least partially between the solder ball tail and the spring beam. The conductive sleeve surrounds the insulator. The conductive sleeve has an opening therethrough that receives the insulator and socket contact. The conductive sleeve provides peripheral shielding for the socket contact along a majority of the contact body between the solder ball tail and the spring beam.

DETAILED DESCRIPTION OF THE INVENTION

Figure 1:
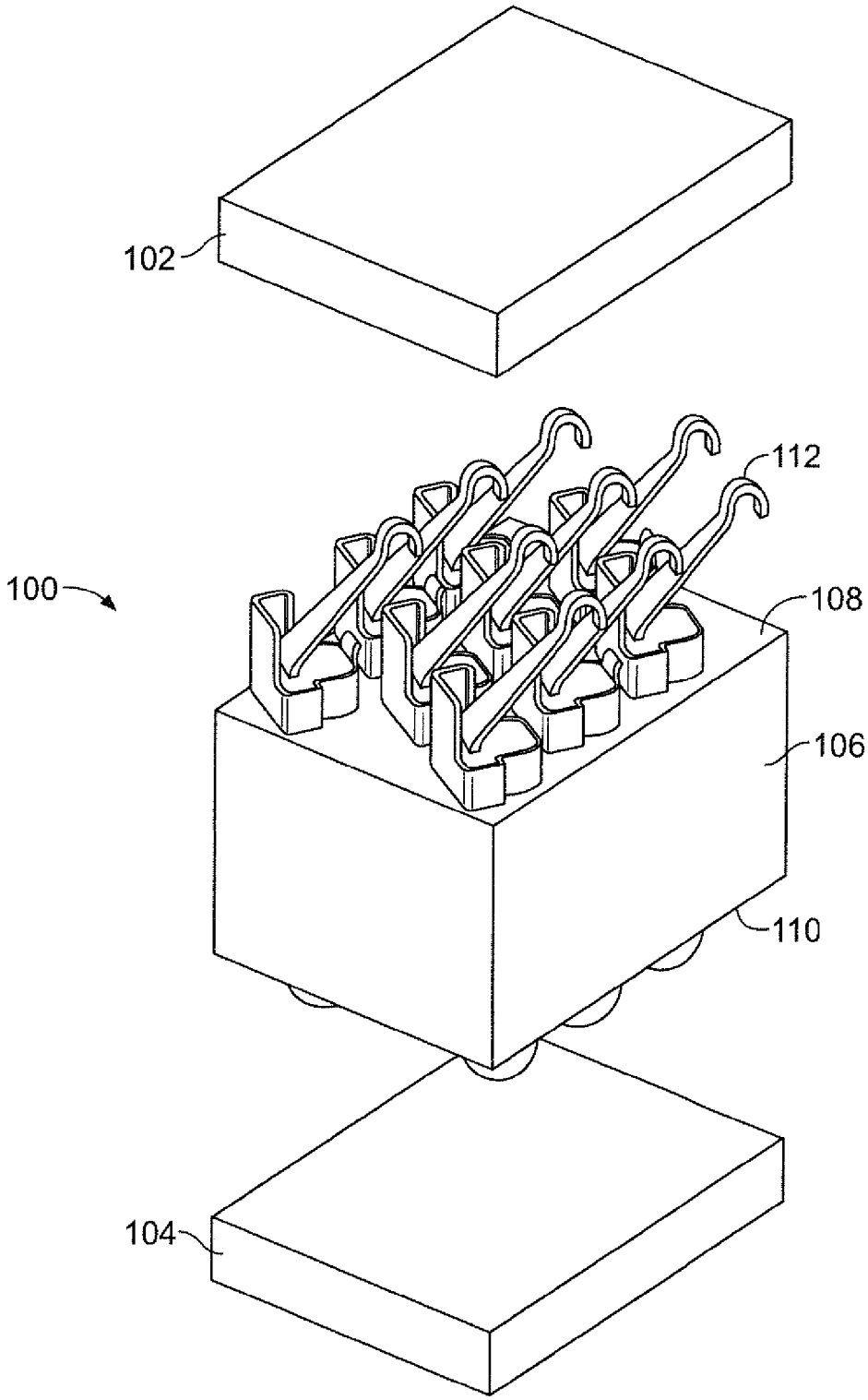
FIG. 1 illustrates a portion of a socket formed in accordance with an exemplary embodiment.

FIG. 1 illustrates a socket 100 used to interconnect a first electronic component 102 with a second electronic component 104. Optionally, the socket 100 may be a land grid array (LGA) socket. The socket 100 may be an interposer or interconnect that is positioned between the first and second electronic components 102, 104 to electrically connect circuits of such components.

In an exemplary embodiment, the socket 100 is mated to the first electronic component 102 at a separable mating interface. The socket 100 may be repeatedly mated and unmated with the first electronic component 102 or similar electronic components. In an exemplary embodiment, the socket 100 may define a test socket for testing an integrated circuit (IC) component or similar type of component. The IC components may be repeatedly tested and removed from the socket 100.

In an exemplary embodiment, the socket 100 is mated to the second electronic component 104 at a mating interface. For example, solder balls may be provided along the mating interface between the socket 100 and the second electrical component 104 to couple the socket 100 to the second electronic component 104. Alternatively, the socket 100 may be mated to the second electronic component 104 at a separable interface, such as by using spring biased contacts to make an electrical connection with the second electronic component 104.

The socket 100 includes a socket body 106 having a first surface 108 and a second surface 110. The socket body 106 holds a plurality of socket contacts 112 for interfacing with the first and second electronic components 102, 104. The socket contacts 112 may be held in openings 114 (shown in FIG. 2) defined within the socket body 106. The socket 100 may hold any number of socket contacts 112. The pattern or arrangement of the socket contacts 112 may correspond with the corresponding contacts or pads on the first and second electronic components 102, 104 to ensure that the socket contacts 112 are mated to corresponding circuits of the first and second electrical components 102, 104.

In an exemplary embodiment, the socket contacts 112 are designed to have a tight pitch between adjacent socket contacts 112. The socket contacts 112 are designed to be deflectable at the first surface 108 and/or the second surface 110 for mating with the first electronic component 102 and/or the second electronic component 104. The socket contacts 112 may be designed to have a low compression load for mating the first and/or second electronic components 102, 104 with the socket. In an exemplary embodiment, the socket contacts 112 are individually shielded from other socket contacts 112 to enhance the electrical performance of the socket 100. The shielding of the socket contacts 112 allows the socket 100 to have better electrical performance than the open pin field method of conventional sockets.

Figure 2:
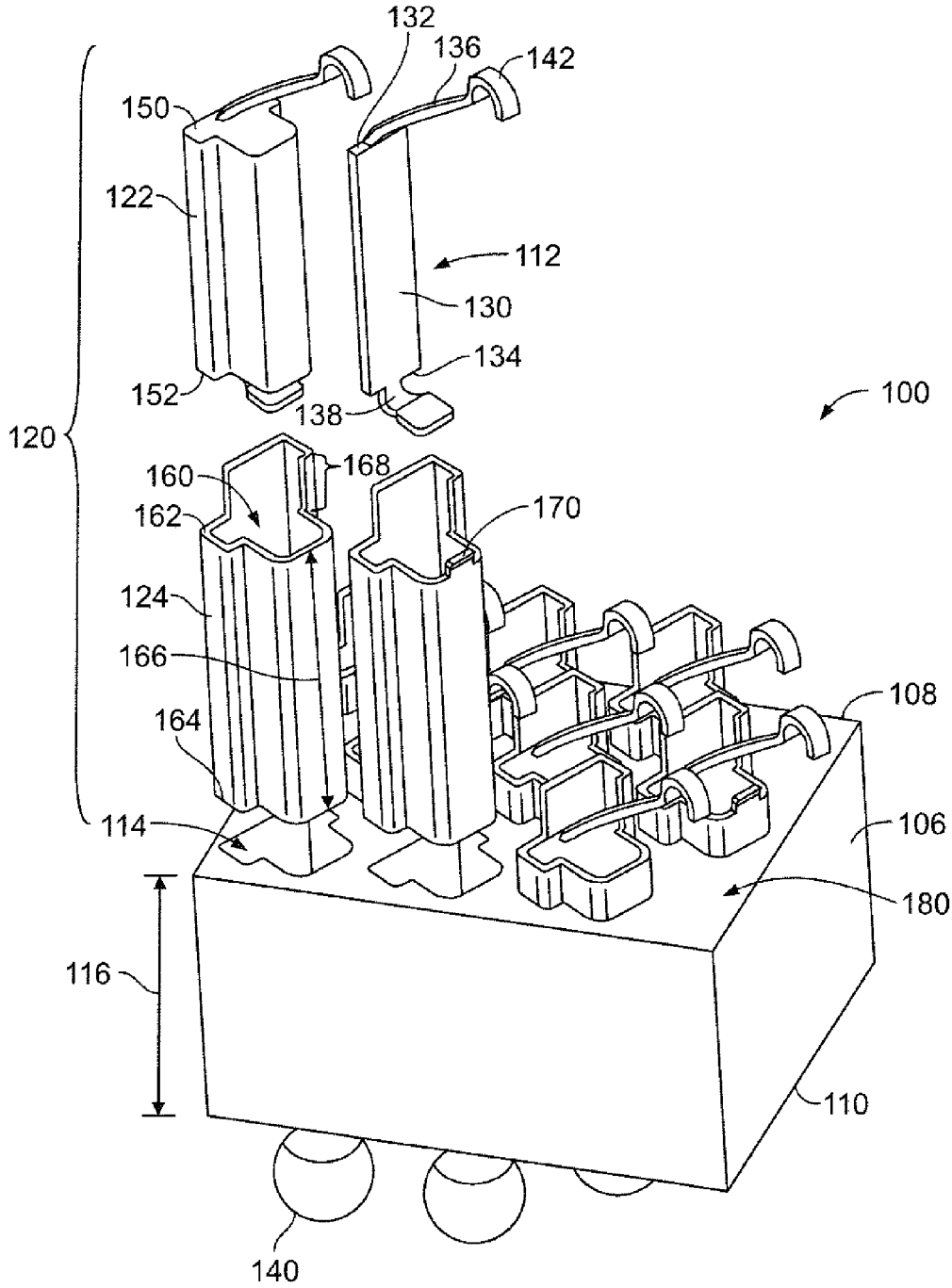
FIG. 2 is an exploded view of a portion of the socket.

FIG. 2 is an exploded view of a portion of the socket 100. The openings 114 are shown extending through the socket body 106 between the first surface 108 and the second surface 110. The openings have a height 116, which corresponds to the height measured between the first and second surfaces 108, 110. The openings 114 are sized, shaped and positioned to receive corresponding sleeve assemblies 120 therein. The socket contacts 112 are part of the sleeve assemblies 120 and are received in corresponding openings 114.

In an exemplary embodiment, each sleeve assembly 120 provides electrical shielding for the corresponding socket contact 112. The sleeve assembly 120 includes the socket contact 112, an insulator 122 surrounding the socket contact 112 (one contact is shown with the corresponding insulator 122 removed for clarity) and a conductive sleeve 124 that receives the insulator 122 and socket contact 112. The conductive sleeve 124 provides electrical shielding around the socket contact 112. The insulator 122 electrically isolates the socket contact 112 from the conductive sleeve 124. In an exemplary embodiment, the conductive sleeves 124 are tall enough that the conductive sleeves 124 provide electrical shielding through the entire socket body 106.

The socket contact 112 has a contact body 130 extending between a top 132 and a bottom 134 of the contact body 130. The contact body 130 is surrounded by the insulator 122. In an exemplary embodiment, the contact body 130 is generally planar between the top 132 and the bottom 134. The size and shape of the contact body 130 may be designed to control the impedance of the socket contact 112 as the socket contact 112 extends through the conductive sleeve 124.

The socket contact 112 includes a spring beam 136 extending from the top 132 of the contact body 130. The socket contact 112 includes a tail 138 extending from the bottom 134 of the contact body 130. The spring beam 136 is configured to engage the first electronic component 102 when the first electronic component 102 is mounted to the socket 100. The tail 138 is configured to be electrically connected to the second electronic component 104 when the socket 100 is mounted to the second electronic component 104. In an exemplary embodiment, solder balls 140 are coupled to the tail 138 to provide an electrical interface between the socket contacts 112 and the second electronic component 104. The tails 138 define solder ball pedestals for mounting the solder balls 140 to the socket contacts 112. Other types of tails may be used in alternative embodiments, such as spring beams similar to the spring beams 136, compliant pins or other types of tails.

The spring beam 136 extends at an angle from the contact body 130. The spring beam 136 is deflectable toward and away from the socket body 106. When the spring beam 136 is deflected, the spring beam 136 imparts a biasing force against the first electronic component 102 to ensure that the spring beam 136 maintains electrical contact with the first electronic component 102. The spring beam 136 includes a mating tip 142 proximate to the distal end of the spring beam 136. The mating tip 142 is curved to allow the spring beam 136 to wipe along the corresponding mating pad of the first electronic component 102 during mating therewith.

The insulator 122 is manufactured from an insulative material, such as a plastic material. The insulator 122 encases the contact body 130. The insulator 122 may be molded around the contact body 130. The insulator 122 extends between a top 150 and a bottom 152. Optionally, the top 150 of the insulator may be approximately flush with the top 132 of the contact body 130 and the bottom 152 may be approximately flush with the bottom 134 of the contact body 130. Optionally, the insulator 122 may extend beyond the top 132 and/or the bottom 134 of the contact body 130. In alternative embodiments, the insulator 122 may be shorter than the contact body 130 such that the top 132 and/or the bottom 134 of the contact body 130 extends from the insulator 122 beyond the top 150 and/or the bottom 152 of the insulator 122.

The insulator 122 is used to position the socket contact 112 within the conductive sleeve 124. The insulator 122 electrically isolates the socket contact 112 from the conductive sleeve 124. In an exemplary embodiment, the insulator 122 is held in the conductive sleeve 124 by an interference fit. The insulator 122 may be secured in the conductive sleeve 124 by other means or features in alternative embodiments.

In the illustrated embodiment, the insulator 122 is T shaped with the front of the insulator 122 being narrower and the rear of the insulator 122 being wider. The contact body 130 extends through the wider part of the insulator 122 proximate to the rear of the insulator 122. The spring beam 136 and the tail 138 are both bent forward from the contact body 130 to extend along the narrow part of the insulator 122. The insulator 122 may have other shapes and alternative embodiments.

The conductive sleeve 124 is manufactured from a conductive material, such as a metal material, and is electrically grounded to provide electrical shielding for the socket contact 112. The conductive sleeve 124 has an opening 160 therethrough that receives the insulator 122 and the socket contact 112. The conductive sleeve 124 extends between a top end 162 and a bottom end 164. The conductive sleeve 124 has a height 166 measured between the top end 162 and the bottom end 164. The opening 160 extends the entire height 166 between the top end 162 and the bottom end 164. The opening 160 is sized and shaped to receive the insulator 122. The outer perimeter of the conductive sleeve 124 is sized and shaped to fit within the opening 114 through the socket body 106. The height 166 of the conductive sleeve 124 is taller than the height 116 of the opening 114 through the socket body 106.

In an exemplary embodiment, the conductive sleeve 124 includes a hood 168 extending upward from the top end 162. The hood 168 provides shielding for a portion of the spring beam 136 from interfering signals. The hood 168 provides shielding above the top end 162 of the conductive sleeve 124.

In the illustrated embodiment, the hood 168 is positioned proximate to the base of the spring beam 136 where the spring beam 136 extends from the contact body 130. In the illustrated embodiment, the hood 168 is separated from the spring beam 136 by air. The insulator 122 does not extend between the spring beam 136 and the hood 168. The hood 168 is positioned away from the spring beam 136 to prevent electrical shorting.

In an exemplary embodiment, at least some of the conductive sleeves 124 have shorting pedestals 170 extending from the top end 162. The shorting pedestals 170 are configured to engage the spring beams 136 of the corresponding socket contacts 112 when the socket contacts 112 are deflected during mating with the first electronic component 102. When such socket contacts 112 engage the shorting pedestals 170, the socket contacts 112 are electrically commoned to the conductive sleeve 124. Such socket contacts 112 are thus electrically grounded.

Figure 3:
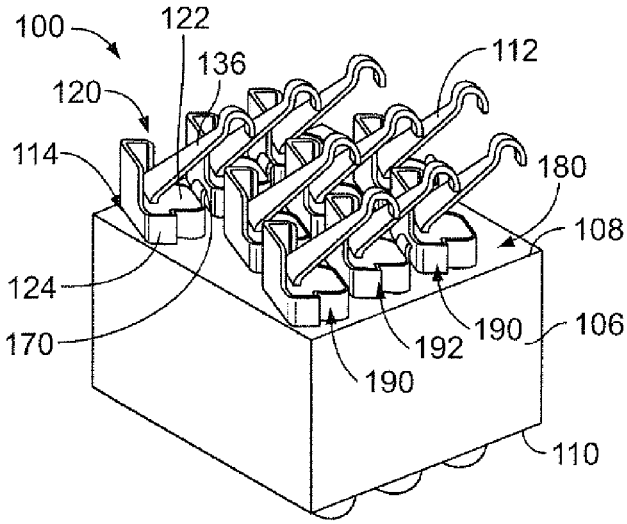
FIG. 3 is a top perspective view of a portion of the socket in an assembled state.

FIG. 3 is a top perspective view of a portion of the socket 100 in an assembled state. During assembly, the insulators 122 and socket contacts 112 are loaded into corresponding conductive sleeves 124. The conductive sleeves 124 are loaded into the openings 114 in the socket body 106. The socket contacts 112 form an array configured to be mated to the first electronic component 102 and the second electronic component 104 (both shown in FIG. 1).

In an exemplary embodiment, the socket body 106 includes a first conductive layer 180 on the first surface 108 and a second conductive layer (not shown) on the second surface 110. The second conductive layer may be similar to the first conductive layer 180. The first conductive layer 180 may be a conductive film, plating applied to the first surface 108 or another type of conductive layer. The first conductive layer 180 may be manufactured from a copper material or another conductive metal material. The first conductive layer 180 physically engages each of the conductive sleeves 124 to electrically common each of the conductive sleeves 124. In an exemplary embodiment, the conductive sleeves 124 extend beyond the first surface 108 to ensure that the conductive sleeves 124 engage the first conductive layer 180. The conductive sleeves 124 extend exterior of the socket body 106, such as beyond the first surface 108 and/or the second surface 110. The conductive sleeves 124 are mechanically and electrically connected to the first conductive layer 180 such that the conductive sleeves 124 are bussed together.

The conductive sleeves 124 are electrically grounded by the first conductive layer 180. The conductive sleeves 124 extend through the socket body 106 to provide shielding for the socket contacts 112 through the socket body 106. The conductive sleeves 124 individually shield each of the socket contacts 112. The conductive sleeves 124 peripherally surround the socket contacts 112 to provide 360° shielding for the socket contacts 112 along a length of the socket contacts 112. In an exemplary embodiment, the conductive sleeves 124 provide shielding along a majority of the length of the socket contacts 112. Optionally, the conductive sleeves 124 provide shielding along the entire length of the contact body 130 (shown in FIG. 2). Optionally, the conductive sleeve 124 may provide shielding along a portion of the spring beam 136 and/or a portion of the tail 138 (shown in FIG. 2).

In an exemplary embodiment, a first subset of the sleeve assemblies 120 defines signal sleeve assemblies 190 and a second subset of the sleeve assemblies 120 defines ground sleeve assemblies 192. The socket contacts 112 of the ground sleeve assemblies 192 are electrically grounded. The ground sleeve assemblies 192 include the conductive sleeves 124 with the shorting pedestals 170. The socket contacts 112 of the ground sleeve assemblies 192 engage the shorting pedestals 170 when the socket 100 and first electronic component 102 are mated together. The socket contacts 112 of the ground sleeve assemblies 192 directly engage and are electrically connected to the conductive sleeves 124 of such ground sleeve assemblies 192. In an exemplary embodiment, the signal sleeve assemblies 190 and the ground sleeve assemblies 192 are interspersed among one another. Optionally, the signal sleeve assemblies 190 may be grouped together in pairs and the ground sleeve assemblies 192 may be interspersed among the pairs of signal sleeve assemblies 190. For example, the socket contacts 112 of the signal sleeve assemblies 190 may define differential pairs of socket contacts 112 that are separated from other pairs of signal sleeve assemblies 190 by one or more ground sleeve assemblies 192. Other arrangements of signal and ground sleeve assemblies 190, 192 are possible in alternative embodiments.

Figure 4:
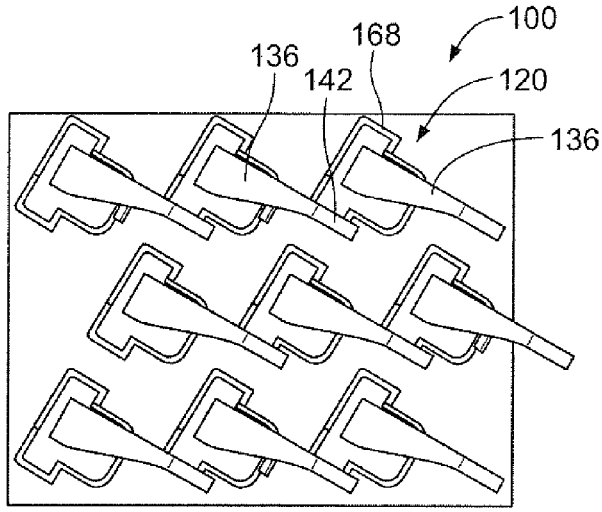
FIG. 4 is a top view of a portion of the socket.

FIG. 4 is a top view of a portion of the socket 100. The spring beams 136 are cantilevered from the contact bodies 130 (shown in FIG. 2). The spring beams 136 extend away from the contact body 130 to the mating tips 142. The amount of deflection of the spring beam 136 is controlled by the length of the spring beam 136. Additionally, the stiffness of the spring beam 136 may be affected by the length and the width of the spring beam 136. In order to achieve adequate deflection, without having the spring beam 136 too stiff for mating with the first electronic component 102, the spring beam 136 overhangs an adjacent sleeve assembly 120. The hoods 168 are sized to accommodate the overhang from an adjacent spring beam 136. For example, the hood 168 is spaced apart from the adjacent spring beam 136.

Figure 5:
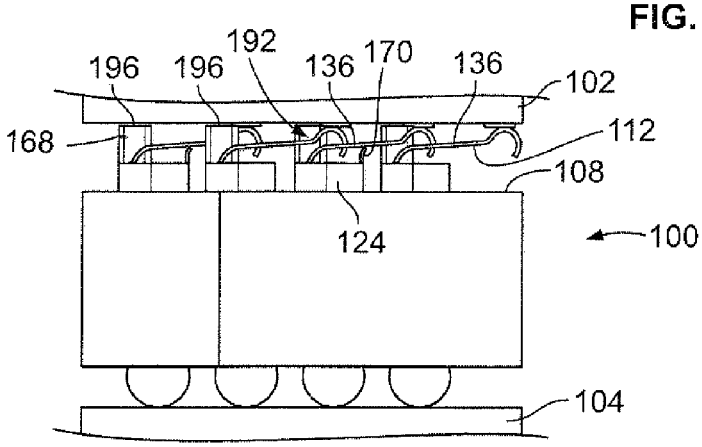
FIG. 5 is a side view of a portion of the socket showing the socket connected between a first electronic component and a second electronic component.

FIG. 5 is a side view of a portion of the socket 100 showing the socket 100 connected between the first electronic component 102 and the second electronic component 104. When the first electronic component 102 is coupled to the socket 100, the socket contacts 112 are deflected toward the first surface 108. The spring beams 136 are bent, which causes the spring beams 136 to be biased against the first electronic component 102. When the spring beams 136 are deflected, the spring beams 136 associated with the ground sleeve assemblies 192 are pressed against the shorting pedestal 170 to electrically ground such spring beams 136 to the corresponding conductive sleeve 124. In an exemplary embodiment, a top 196 of each hood 168 defines a stop for the first electronic component 102. The first electronic component 102 rests on the tops 196 of the hoods 168. The hoods 168 limit the amount of deflection of the spring beams 136.

Figure 6:
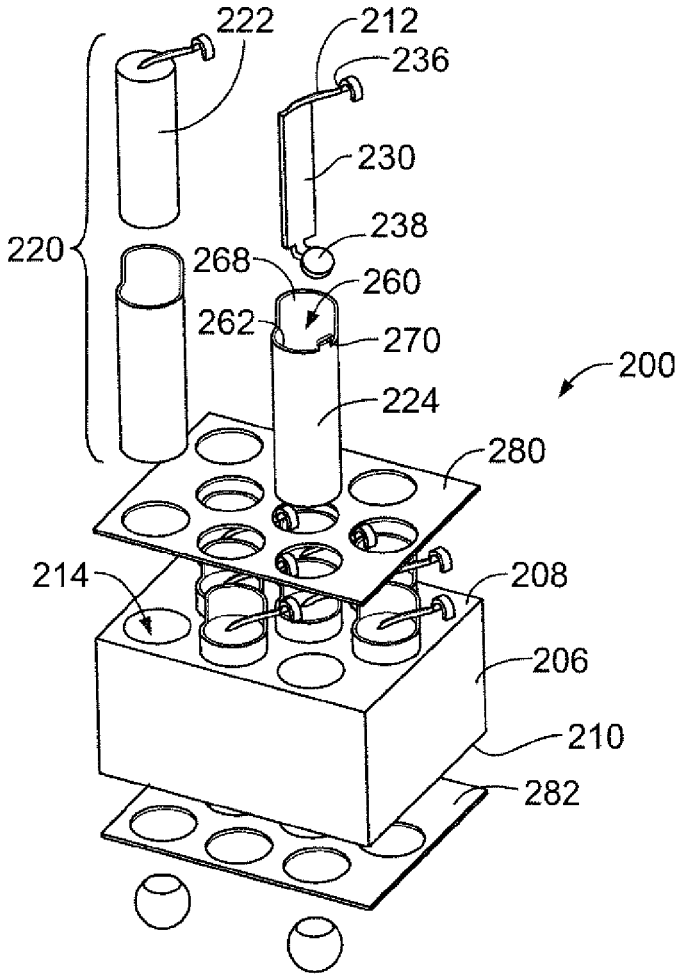
FIG. 6 is an exploded view of a portion of a socket formed in accordance with an exemplary embodiment.

FIG. 6 is an exploded view of a portion of a socket 200 formed in accordance with an exemplary embodiment. The socket 200 is used to interconnect electronic components, such as the electronic components 102, 104. The socket 200 is similar to the socket 100 (shown in FIG. 1), however the socket 200 has insulators and conductive sleeves that have different shapes than the socket 100.

The socket 200 includes a socket body 206 having a first surface 208 and a second surface 210. The socket body 206 holds a plurality of socket contacts 212 for interfacing with the electronic components. The socket contacts 212 are held in openings 214 defined within the socket body 206. The openings 214 are sized, shaped and positioned to receive corresponding sleeve assemblies 220 therein. The socket contacts 212 are part of the sleeve assemblies 220 and are received in corresponding openings 214. In an exemplary embodiment, the sleeve assemblies 220 provide individual shielding for the socket contacts 212 to enhance the electrical performance of the socket 200.

In an exemplary embodiment, each sleeve assembly 220 provides electrical shielding for the corresponding socket contact 212. The sleeve assembly 220 includes the socket contact 212, an insulator 222 surrounding the socket contact 212 and a conductive sleeve 224 that receives the insulator 222 and socket contact 212. The conductive sleeve 224 provides electrical shielding around the socket contact 212. The insulator 222 electrically isolates the socket contact 212 from the conductive sleeve 224. In an exemplary embodiment, the conductive sleeves 224 are tall enough that the conductive sleeves 224 provide electrical shielding through the entire socket body 206.

The socket contact 212 has a contact body 230, a spring beam 236 and a tail 238. The socket contact 212 may be similar to the socket contact 112 (shown in FIG. 2).

The insulator 222 is manufactured from an insulative material, such as a plastic material. The insulator 222 encases the contact body 230. The insulator 222 may be molded around the contact body 230. The insulator 222 is used to position the socket contact 212 within the conductive sleeve 224. The insulator 222 electrically isolates the socket contact 212 from the conductive sleeve 224. In an exemplary embodiment, the insulator 222 is held in the conductive sleeve 224 by an interference fit. The insulator 222 may be secured in the conductive sleeve 224 by other means or features in alternative embodiments. In the illustrated embodiment, the insulator 222 is cylindrically shaped.

The conductive sleeve 224 has an opening 260 therethrough that receives the insulator 222 and the socket contact 212. The opening 260 is sized and shaped to receive the insulator 222. The outer perimeter of the conductive sleeve 224 is sized and shaped to fit within the opening 214 through the socket body 206. The conductive sleeve 224 is manufactured from a conductive material, such as a metal material, and is electrically grounded to provide electrical shielding for the socket contact 212.

In an exemplary embodiment, the conductive sleeve 224 includes a hood 268 extending upward from the top end 262. The hood 268 provides shielding for a portion of the spring beam 236 from interfering signals. In an exemplary embodiment, at least some of the conductive sleeves 224 have shorting pedestals 270 extending from the top ends of the conductive sleeves 224. The shorting pedestals 270 are configured to engage the spring beams 236 of the corresponding socket contacts 212 when the socket contacts 212 are deflected during mating with the electronic component.

During assembly, the insulators 222 and socket contacts 212 are loaded into corresponding conductive sleeves 224. The conductive sleeves 224 are loaded into the openings 214 in the socket body 206. The socket contacts 212 form an array configured to be mated to the electronic components.

In an exemplary embodiment, the socket body 206 includes a first conductive layer 280 on the first surface 208 and a second conductive layer 282 on the second surface 210. The conductive layers 280, 282 may be conductive films, plating applied to the surfaces 208, 210 or other types of conductive layer. The conductive layers 280, 282 physically engage the conductive sleeves 224 to electrically common the conductive sleeves 224.

The conductive sleeves 224 extend through the socket body 206 to provide shielding for the socket contacts 212 through the socket body 206. The conductive sleeves 224 individually shield each of the socket contacts 212. The conductive sleeves 224 peripherally surround the socket contacts 212 to provide 360° shielding for the socket contacts 212 along a length of the socket contacts 212.

Figure 7:
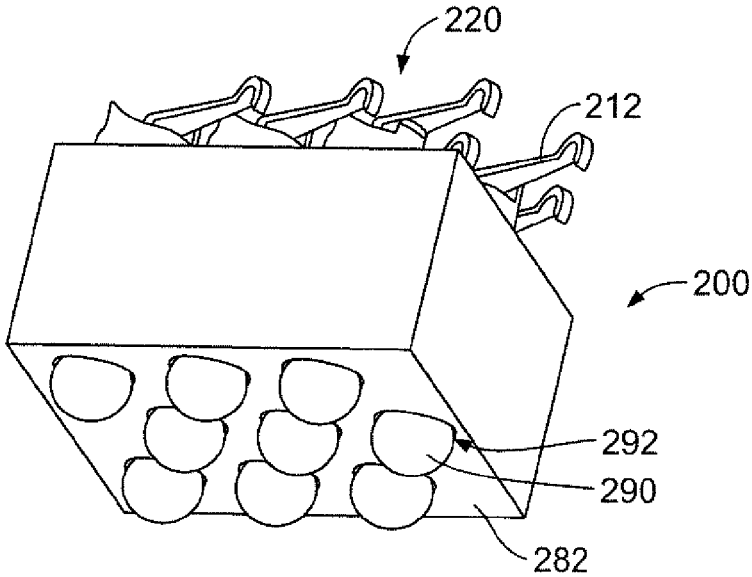
FIG. 7 is a bottom view of a portion of the socket shown in FIG. 6.

FIG. 7 is a bottom view of a portion of the socket 200. Solder balls 290 are coupled to the socket contacts 212. The solder balls 290 are arranged in corresponding openings 292 in the second conductive layer 282. Alternatively, the sleeve assemblies 220 may extend beyond the second conductive layer 282 to position the solder balls 290 below the second conductive layer 282.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A socket comprising:

a socket body having a first surface and a second surface, the socket body having a plurality of openings extending between the first and second surfaces;

sleeve assemblies received in corresponding openings of the socket body, each sleeve assembly comprising a socket contact configured to interconnect a first electronic component and a second electronic component and each sleeve assembly comprising a conductive sleeve extending along a majority of a length of the socket contact between the first and second electronic components, the conductive sleeve providing electrical shielding for the socket contact such that each socket contact is individually shielded from other socket contacts; wherein the socket contact has a spring beam that is cantilevered from a contact body thereof to extend over another conductive sleeve of another sleeve assembly.

2. The socket of claim 1, wherein the conductive sleeve provides shielding for an entire length of the socket contact between the first and second surfaces.

3. The socket of claim 1, wherein the conductive sleeve includes a top end and a bottom end, the top end being flush with or extending exterior of the socket body beyond the first surface, the bottom end being flush with or extending exterior of the socket body beyond the second surface.

4. The socket of claim 1, wherein the openings have a height measured between the first and second surfaces, the conductive sleeve having a height measured between opposite top and bottom ends of the conductive sleeve, the height of the conductive sleeve being taller than the height of the opening.

5. The socket of claim 1, wherein the first surface has a conductive layer, the conductive sleeves being mechanically and electrically connected to the conductive layer such that the conductive sleeves are bussed together.

6. The socket of claim 1, wherein the socket contact has a tail that is terminated to a solder ball.

7. A sleeve assembly for a socket, the sleeve assembly comprising:

a socket contact having a contact body, a solder ball tail extending from the contact body for electrical connection with a solder ball, and a spring beam extending from the contact body opposite the solder ball tail, the spring beam being angled with respect to the contact body, the spring beam being deflectable, the spring beam being configured to be mated with and biased against a first electronic component at a separable interface of the spring beam;

an insulator surrounding the contact body, the insulator extending axially along the contact body at least partially between the solder ball tail and the spring beam; and a conductive sleeve surrounding the insulator, the conductive sleeve having an opening therethrough that receives the insulator and socket contact, the conductive sleeve providing peripheral shielding for the socket contact along a majority of the contact body between the solder ball tail and the spring beam.

8. The socket of claim 1, wherein a first subset of the sleeve assemblies defines signal sleeve assemblies and a second subset of the sleeve assemblies defines ground sleeve assemblies, the socket contacts of the ground sleeve assemblies directly engaging and being electrically connected to the conductive sleeve of such ground sleeve assembly.

9. The socket of claim 8, wherein the conductive sleeves of the ground sleeve assemblies have shorting pedestals extending from a top end of the conductive sleeves, the shorting pedestals engaging the socket contacts.

10. A socket comprising:

a socket body having a first surface and a second surface, the socket body having a plurality of openings extending between the first and second surfaces; and sleeve assemblies received in corresponding openings of the socket body, the sleeve assemblies comprising:

a socket contact having a contact body, a tail extending from the contact body for electrical connection with an electronic component at the second surface of the socket body, and a spring beam extending from the contact body opposite the tail, the spring beam being angled with respect to the contact body and extending along, and spaced apart from, the first surface of the socket body, the spring beam being deflectable toward the first surface of the socket body when mated with an electronic component at the first surface of the socket body;

an insulator surrounding the contact body, the insulator extending axially along the contact body at least partially between the tail and the spring beam; and a conductive sleeve surrounding the insulator, the conductive sleeve having an opening therethrough that receives the insulator and socket contact, wherein the conductive sleeve, insulator and contact body are received in a corresponding opening of the socket body, the conductive sleeve providing shielding along the contact body between the first surface and the second surface.

11. The socket of claim 10, wherein the conductive sleeve provides shielding for an entire length of the socket contact between the first and second surfaces.

12. The socket of claim 10, wherein the conductive sleeve includes a top end and a bottom end, the top end being flush with or extending exterior of the socket body beyond the first surface, the bottom end being flush with or extending exterior of the socket body beyond the second surface.

13. The socket of claim 10, wherein the first surface has a conductive layer, the conductive sleeves being mechanically and electrically connected to the conductive layer such that the conductive sleeves are bussed together.

14. The socket of claim 10, wherein a first subset of the sleeve assemblies defines signal sleeve assemblies and a second subset of the sleeve assemblies defines ground sleeve assemblies, the socket contacts of the ground sleeve assemblies directly engaging and being electrically connected to the conductive sleeve of such ground sleeve assembly.

15. The socket of claim 14, wherein the conductive sleeves of the ground sleeve assemblies have shorting pedestals extending from a top end of the conductive sleeves, the shorting pedestals engaging the spring beams of the socket contacts when the spring beams are deflected when mated with the electronic component.

16. The socket of claim 10, wherein the insulators extend entirely between the spring beams and the tails, the conductive sleeves extend an entire length of the insulators.

17. The socket of claim 10, wherein the conductive sleeve includes a hood extending upward from a top end of the conductive sleeve, the hood shielding a portion of the spring beam from interfering signals.

18. The sleeve assembly of claim 7, wherein the conductive sleeve includes a shorting pedestal, the spring beam engaging the shorting pedestal when the spring beam is mated with the first electronic component.

19. The sleeve assembly of claim 7, wherein the conductive sleeve extends along an entire length of the contact body to provide shielding along the entire length of the contact body.

* * * * *